US005956790A

United States Patent [19]

Braunschweig et al.

[11] Patent Number: 5,956,790

[45] Date of Patent: Sep. 28, 1999

[54] INSTALLATION SYSTEM FOR STACKED APPLIANCES

[75] Inventors: James R. Braunschweig, Colfax; Daniel F. Wunderlich, Newton, both of Iowa

[73] Assignee: Maytag Corporation, Newton, Iowa

[21] Appl. No.: 09/168,546

[22] Filed: Oct. 8, 1998

Related U.S. Application Data

[62] Division of application No. 08/969,682, Nov. 13, 1997.

[51] Int. Cl.[6] ..... D06F 29/00

[52] U.S. Cl. ..... 8/159; 68/3 R; 68/19.2; 68/20

[58] Field of Search ..... 68/3 R, 19.2, 20; 8/158, 159

[56] References Cited

U.S. PATENT DOCUMENTS

| | | | |
|---|---|---|---|
| 2,793,518 | 5/1957 | Geldhof | 68/19 |
| 2,833,137 | 5/1958 | Geldhof | 68/19 |
| 4,120,180 | 10/1978 | Jedora | 68/20 |
| 4,187,701 | 2/1980 | Wendel | 68/20 |
| 4,526,535 | 7/1985 | Wunderlich | 432/105 |

*Primary Examiner*—Frankie L. Stinson

*Attorney, Agent, or Firm*—Zarley, McKee, Thomte, Voorhees & Sease

[57] ABSTRACT

An improved installation system for a stacked washer and dryer appliance assembly having an exhaust vent and a gas system is provided. The exhaust vent system includes an exhaust bracket extending upwardly from the back of the washer. The exhaust bracket is adapted to be connected to a household exhaust duct, with the exhaust pipe of the dryer being automatically sealingly engaged with the exhaust bracket upon positioning of the dryer on the washer. The gas system includes a gas pipe in the washer, and having a rearward end extending out of the back of the washer for connection to a gas source. The forward end of the gas pipe has a shutoff valve, which is adapted to be connected to a gas line operatively mounted in the dryer. All of the connections for the power, water, exhaust, and gas for the stacked appliances can be quickly and easily made, without having to stand behind the appliance assembly after the dryer is mounted on the washer.

6 Claims, 4 Drawing Sheets

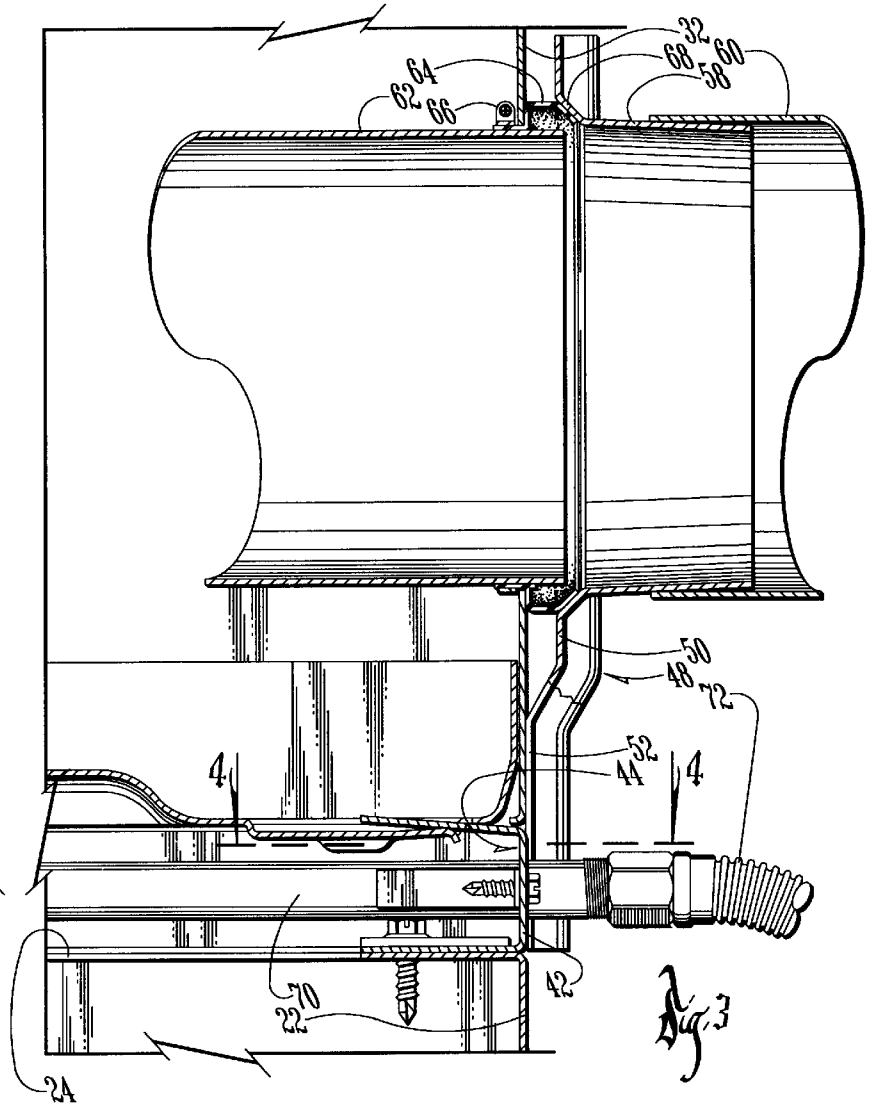
Fig. 3
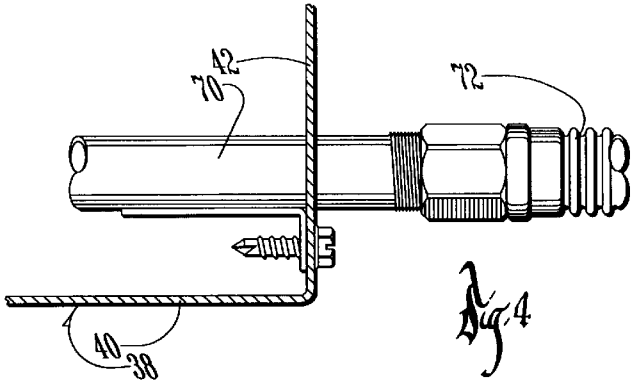
Fig. 4
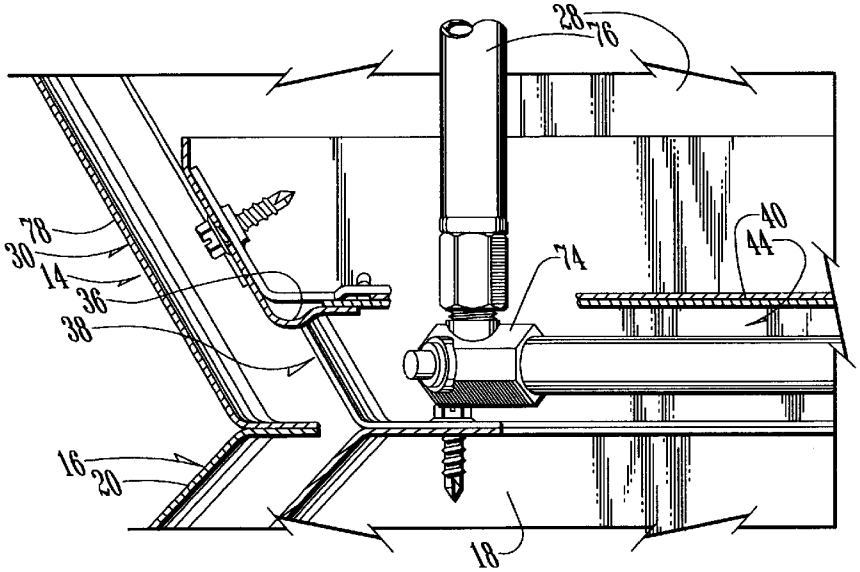

INSTALLATION SYSTEM FOR STACKED APPLIANCES

This is a divisional of copending application Ser. No. 08/969,682 filed on Nov. 13, 1997 and still pending.

BACKGROUND OF THE INVENTION

Stacked appliances, such as a clothes washer and dryer, are common in houses and buildings where space is limited, such as in apartments. In conventional stacked appliances, the upper unit, usually the dryer, is set upon the lower unit and brackets are attached to the backs of the units to secure them together. The interconnected stacked units are then slid into position against a wall or into an alcove.

Several problems exist with such conventional mounting arrangement for stacked appliances. First, the weight of the interconnected appliances makes it more difficult to move the stacked units into position against the wall or in the alcove, as compared to moving only one of the units into position. Secondly, accessibility to the backs of the units is limited, thus making hook-ups with the dryer vent, electricity, and gas more complicated.

Accordingly, a primary objective of the present invention is the provision of improved stacked appliances having quick and easily accessible hookups for the exhaust vent, gas and electricity.

Another objective of the present invention is the provision of stacked appliances having exhaust vent, gas and electrical connections on the washer for coupling with the dryer.

Another objective of the present invention is the provision of an improved method for installing stacked appliances wherein the exhaust duct and incoming gas line are coupled to the lower unit before the upper unit is installed on the lower unit.

These and other objectives will become apparent from the following description of the invention.

SUMMARY OF THE INVENTION

An installation system is provided for stacked appliances having a vent system, a gas system and an electrical connection. The stacked appliances generally include a lower washer and an upper dryer. An exhaust bracket extends upwardly above the top of the washer from the back side thereof, and is adapted to be coupled with a household exhaust duct. An exhaust pipe is located at the back of the dryer for automatic coupling with the exhaust bracket when the dryer is positioned on the washer. First and second electrical connectors are located in the washer and dryer and are joined after the dryer is positioned on the washer.

The gas system includes a gas pipe mounted in the washer with a rearward end extending out of the washer for attachment to a gas source. A shut off valve is on the forward end of the gas pipe adjacent the front of the washer. After the dryer is positioned on the washer, a gas line in the dryer is attachable to the shut off valve, which can be opened to provide gas to the dryer.

The present invention also includes a method of assembling stacked appliances. The method includes positioning the washer adjacent a wall, and coupling the exhaust bracket to the exhaust duct. The dryer is then positioned onto the washer such that the exhaust pipe is automatically coupled to the exhaust bracket. The method also includes the steps of coupling the gas pipe extending from the washer to a gas source, positioning the dryer on the washer coupling the gas line in the dryer to the gas pipe in the washer and then joining the electrical connectors.

BRIEF DESCRIPTION OF THE DRAWINGS

FIG. 3 is a sectional view taken along lines 3—3 of FIG. 2.

FIG. 4 is a sectional view taken along lines 4—4 of FIG. 3.

DETAILED DESCRIPTION OF THE DRAWINGS

Figure 1:
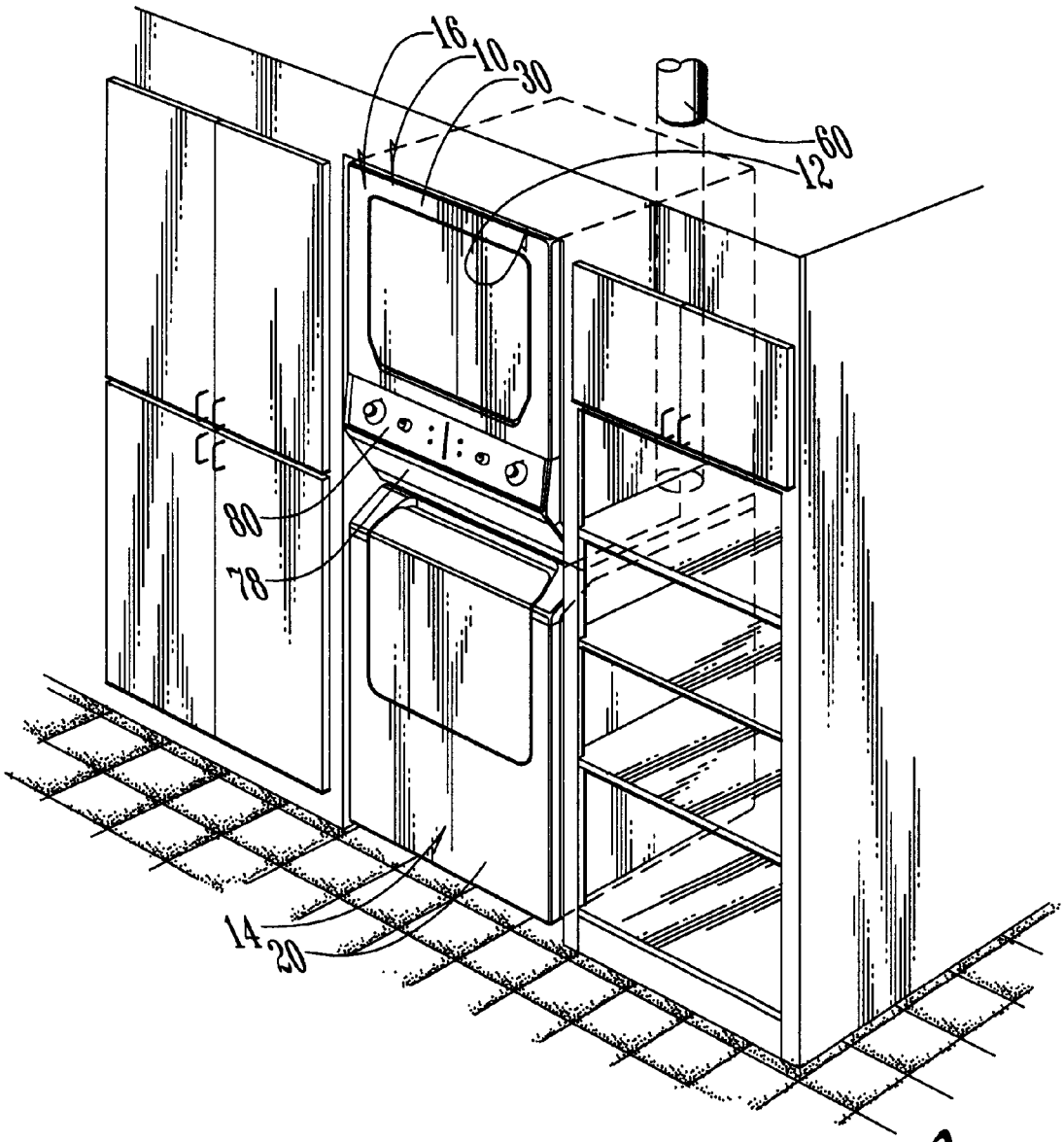
FIG. 1 is a perspective view of the stacked appliances positioned in an alcove.
Figure 2:
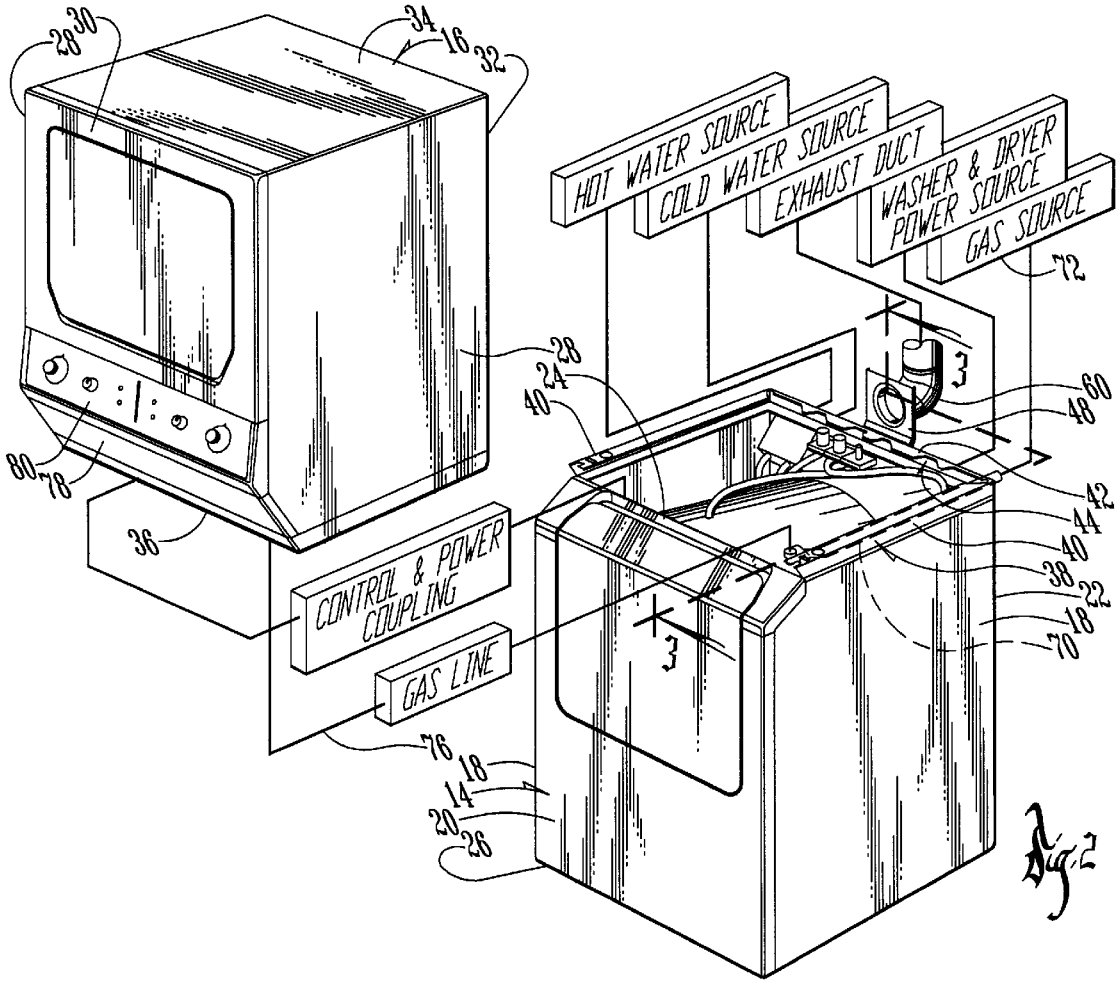
FIG. 2 is an exploded perspective view of the washer and dryer, with schematic illustration of the various hookups for the washer and dryer.

With reference to the drawings, the numeral 10 generally designates a stacked appliance assembly installed in an alcove 12 of a utility room. More particularly, the stacked appliance assembly 10 includes a washer 14 and a dryer 16. The washer 14 includes opposite sides 18, a front 20, a back 22, a top 24, and a bottom 26. Similarly, the dryer 16 includes opposite sides 28, a front 30, a back 32, a top 34, and a bottom 36.

The dryer 16 is mounted on a support member 38 extending around at least a portion of the perimeter of the top 24 of the washer 14. The particular construction of the mounting arrangement between the washer 14 and the dryer 16 is disclosed in applicant's co-pending application Ser. No., filed, 1997.

Preferably, the support member 38 includes opposite side rails 40 and a back rail 42. At least the rail 40 has a C-shaped cross section to define a channel 44, as best seen in FIG. 3.

An exhaust bracket 48 is connected to the back 22 of the washer 14 and extends upwardly therefrom. The bracket 48 is generally in the form of a plate 50 having a lower portion 52 adapted to be connected to the support member 38 using metal screws or the like extending through holes 54. A small tab 56 on the lower portion 52 is adapted to be received in a slot in the support member 38 to facilitate attachment of the exhaust bracket 48 thereto. It is noted that the exhaust bracket 48 could readily be attached to the back 22 of the washer 14 if desired. The exhaust bracket 48 includes a short pipe section 58 extending rearwardly for connection to an exhaust duct 60.

Figure 5:
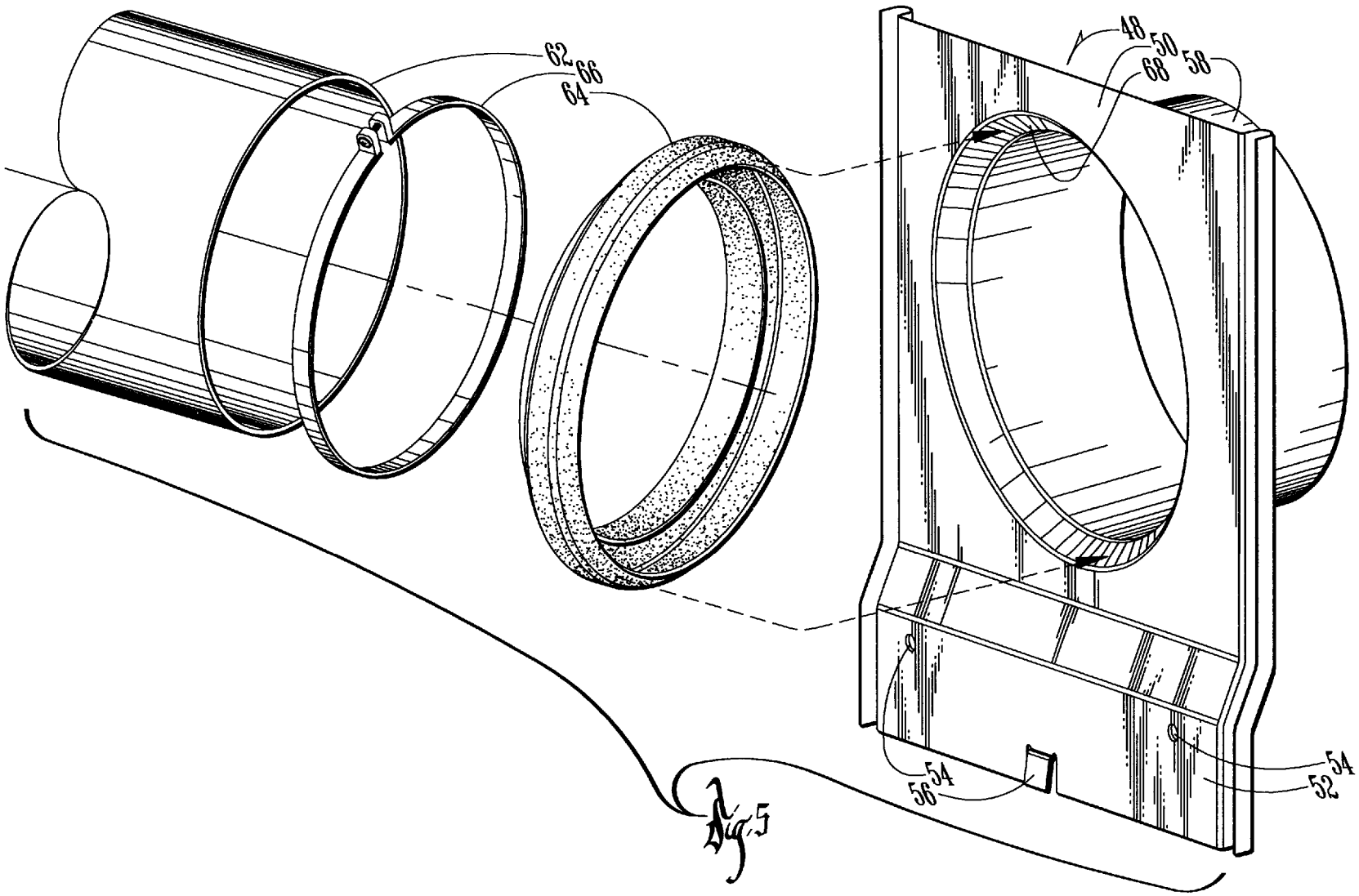
FIG. 5 is an enlarged exploded view of the exhaust bracket of the washer and the exhaust pipe of the dryer.

An exhaust pipe 62 is operatively connected to the dryer 16 and can be substantially flush with or extend rearwardly from the back 32. A gasket or seal 64 is secured to the end of the exhaust pipe 62 by a collar 66 in this embodiment. The seal 64 provides sealing engagement between the exhaust pipe 62 and the exhaust bracket 48. Preferably, as best seen in FIG. 5, the exhaust bracket 48 includes an angled perimeter surface 68 which automatically matingly receives a complementary surface of the seal 64 when the dryer 16 is positioned on the washer 14. It is understood that surface 68 is not the only workable configuration and that the mating surface could be flat so that seal 68 makes contact and provides substantial airtight engagement.

A gas pipe 70 is removably cradled in the side channel 44 of the support member 38. The rearward end of the gas pipe 70 extends out of the back rail 42 of the support member 38 for coupling with a gas source 72. The forward end of the gas pipe 70 includes a shut-off valve 74. A gas line 76, which is operatively connected to the gas valve (not shown) of the dryer 16, is adapted to be coupled to the shut-off valve 74 of the gas pipe 70 after the dryer 16 has been positioned on the washer 14.

The method of installing the stacked appliances 10 in the alcove 12 includes the steps of partially or fully moving the washer 14 into the alcove 12, connecting the gas pipe 70 to the gas source 72, hooking up the hot and cold water lines to the washer 14, and plugging the electrical line (not shown) of the washer into an electrical outlet (not shown). The washer 14 is then moved completely into the alcove 12 (if not previously done) such that the exhaust duct 60 can be quickly and easily connected to the pipe section 58 of the exhaust bracket 48, without having to stand or otherwise get behind the washer 14. The dryer 16 is then set upon the support member 38 and slid rearwardly into engagement with the back rail 42 of the support member 38. The exhaust pipe 62 of the dryer 16 is positioned so as to automatically align and mate the seal 64 with the exhaust bracket 48 of the washer upon rearward sliding positioning of the dryer 16 on the washer 14. Then, the access panel 78 of the dryer 16 is removed (if not already done) to provide easy access for connecting the gas line 76 of the dryer to the shut-off valve 74 of the gas pipe 70 mounted in the support member 38. An electrical coupling of the control panel 80 for the washer and dryer is made adjacent the front 20 and top 24 of the washer 14. The electrical coupling provides operating power to the dryer 16 and electrical communication between the control panel 80 and various controlled components of the washer 14 such as valves, motor, unbalance control switch, etc.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. An improved stacked appliance assembly including a lower washer and an upper dryer, the washer and dryer each having a front, a back, a top, a bottom, and opposite sides, the improvement comprising:

a gas pipe mounted in the washer and having a first end extending out of the washer for attachment to a gas source and a second end; and a gas line mounted in the dryer for attachment to the second end of the gas pipe after the dryer is positioned on the washer.

2. The improved stacked appliance assembly of claim 1 further comprising a gas valve on the second end of the gas pipe to control gas flow from the gas source to the gas line of the dryer.

3. The improved stacked appliance assembly of claim 1 wherein the second end of the gas pipe is positioned adjacent the front of the washer.

4. The improved stacked appliance assembly of claim 1 wherein the second end of the gas pipe is positioned adjacent the top of the washer.

5. A method of assembling stacked appliances including a washer and a gas dryer, comprising: coupling a first end of a gas pipe mouted in and extending from the washer to a gas source;

positioning the dryer upon the washer; and then coupling a gas line in the dryer to a second end of the gas pipe.

6. The method of claim 5, including positioning the washer adjacent a rear wall before positioning the dryer on the washer.

* * * * *